United States Patent [19]

Scaglione

[11] 4,150,371

[45] Apr. 17, 1979

[54] TAMPER INDICATOR

[75] Inventor: Dennis J. Scaglione, Clinton, Conn.

[73] Assignee: Ripley Company, Inc., Cromwell, Conn.

[21] Appl. No.: 884,910

[22] Filed: Mar. 9, 1978

[51] Int. Cl.[2] ..... G08B 13/06

[52] U.S. Cl. ..... 340/568; 200/61.81; 324/110; 324/156; 340/637; 340/687

[58] Field of Search ..... 340/571, 568, 687, 637, 340/635, 541; 324/110, 157, 156; 200/61.81, 51.1

[56] References Cited

U.S. PATENT DOCUMENTS

| | | | |
|---|---|---|---|
| 3,696,371 | 10/1973 | Wise | 340/687 |
| 3,781,857 | 12/1973 | Stendig et al. | 340/568 |
| 3,878,507 | 4/1975 | Medlock | 340/568 |
| 4,047,167 | 9/1977 | Helena | 340/568 |

*Primary Examiner*—Glen R. Swann, III

*Attorney, Agent, or Firm*—DeLio and Montgomery

[57] ABSTRACT

A tamper-detection switch is built into a device such as an encoder for a gas or water meter. The switch has a contact arm biased to complete an alarm circuit, but this is prevented by a restraining post. On installation, an actuator is moved by contact with the meter to lift the contact arm free of the restraining post, at the same time restraining the arm from completing the circuit. If the encoder is subsequently moved away from the meter, a biasing spring causes the actuator to move out of the path of the contact arm, freeing it to complete the alarm circuit.

10 Claims, 9 Drawing Figures

TAMPER INDICATOR

BACKGROUND OF THE INVENTION

This invention relates to a device for giving, irreversably, a local and/or remote warning or alarm signal when an encoder or the like, attached to a gas, electric or water meter, is removed or displaced as by a person intending to alter the meter.

In certain systems for metering the use of utilities, such as gas, electricity or water by customers, meters are installed inside the building, equipped with encoders and connected to receptacles on the outside of the building so that the meter reader can insert a special probe into each receptacle and obtain a reading of the condition of the respective meter. In such systems there is the possibility that a dishonest customer will remove the encoder and adjust the meter to indicate a lower rate of consumption, resulting in an improperly low gas or electric bill. Since the encoder is normally bolted to the meter in a relatively simple manner, such tampering may well go undetected and be unprovable even when suspected. Gas, electric and water meters are hereinafter sometimes referred to as "energy monitoring" meters; as meters they are, of course, quite different, but the tampering problem is common to all.

SUMMARY OF THE INVENTION

It is accordingly an object of the present invention to provide a tamper indicator which is preset to be actuated as a function of the loosening or removal of the encoder and to give a visual, audible, electrical or other warning signal at a remote point, as at the outside receptacle, to indicate that tampering has occurred.

It is a further object of the invention to provide such a tamper indicator which cannot be reset by replacing the encoder after it has been removed.

It is another object of the invention to provide a tamper indicator which can be provided with a visual signal device to constitute a local indication of tampering.

It is a still further object of the invention to provide a tamper indicator which is suitable for incorporation into other electrical or mechanical systems where the detection of unauthorized removal or entry is desired.

It is yet another object of the invention to provide a tamper indicator which is adapted not only to signal the unauthorized alteration of a mechanical relationship between certain elements, but also to effect, through a relay or directly, a corrective action such as cutting off a high voltage current from an area to which unauthorized entry has been effected.

It is also an object of the invention to provide certain improvements in the form, construction and arrangement of the several parts whereby the abovenamed and other objects may effectively be attained.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

A practical embodiment of the invention is shown in the accompanying drawings, wherein.

DESCRIPTION OF THE PREFERRED EMBODIMENTS

Figure 1:
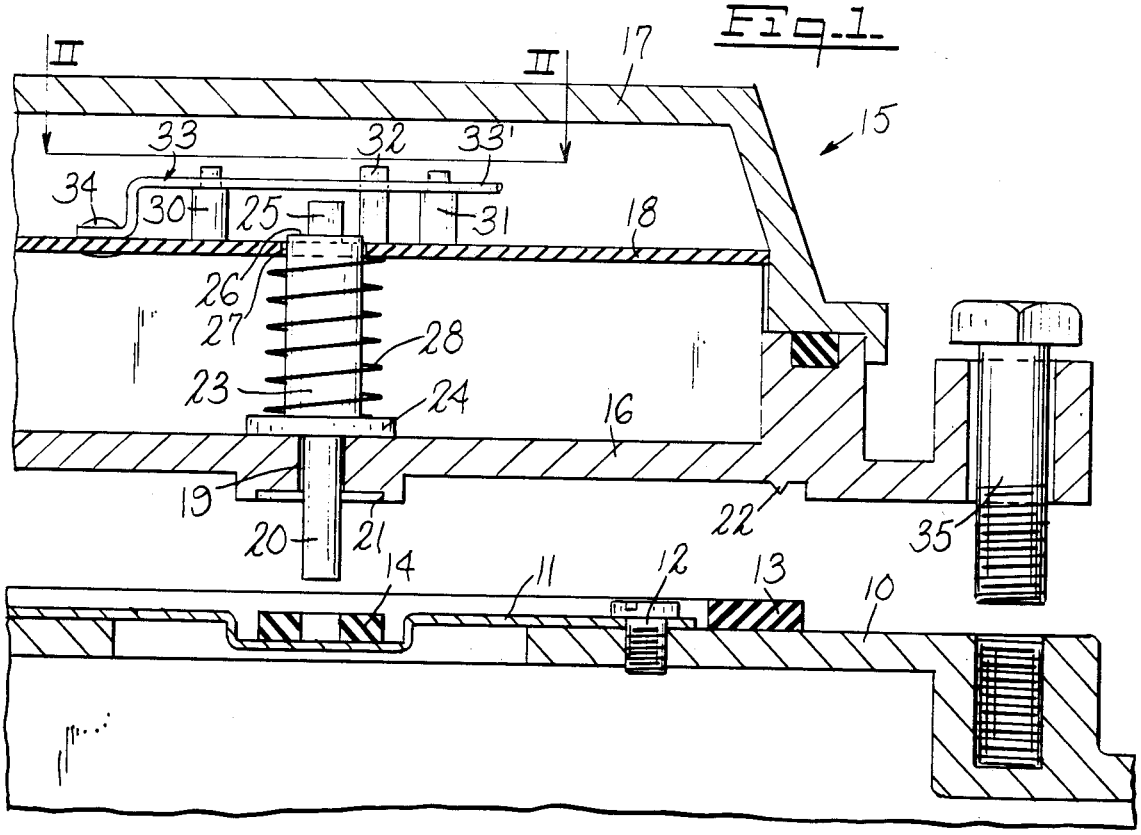
FIG. 1 represents a horizontal section through the encoder housing and an adjacent wall of a meter to which the encoder is to be attached, the tamper indicator being shown in its preinstalled condition, and parts being broken away.

Referring to the drawings, only those elements of a remote reading coded meter system which are most pertinent to the present invention are illustrated. In FIG. 1, the front wall 10 of a meter case is provided with the indicator actuation plate 11 securely attached by bolts 12 and surrounded by a flat gasket 13. The plate is shown as being centrally recessed and provided with an annular seal 14 to receive the actuation rod of the indicator.

The encoder is shown generally at 15; it has a back wall 16, front wall 17 and houses a printed circuit board 18, parallel to the walls 16, 17 and spaced about midway between them. The encoder comprises also devices which are designed to monitor the gas, electricity or water consumption readings of the meter mechanisms and to transmit coded signals to an outdoor receptacle where they can be read by complementary devices in a probe carried by the meter reader. The details of the encoder are not part of the present invention. The back wall 16 is bored at 19 to permit passage of the actuation rod 20, the wall also being provided with a flanged seat 21 and a sealing ridge 22, adapted to make sealing engagement, respectively, with the seal 14 and gasket 13 when the encoder is mounted on the meter, as by means of the bolts 35.

The actuation rod 20 includes an enlarged cylindrical portion 23, a stop flange 24 and a retaining post 25, at the base of which the outer end of the portion 23 forms an annular shoulder 26. The circuit board 18 has an opening 27 through which the portion 23 can pass freely and a spring 28, around the porton 23, bears against the circuit board and the flange 24 to bias the actuation rod toward its rearwardly projecting position.

Figure 2:
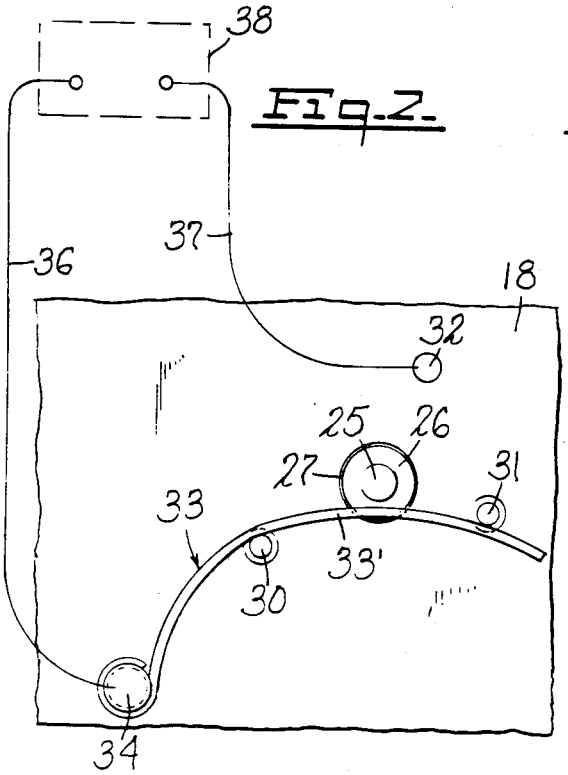
FIG. 2 represents a detail elevation from the line II—II of FIG. 1, appropriate circuitry being indicated diagrammatically.
Figure 3:
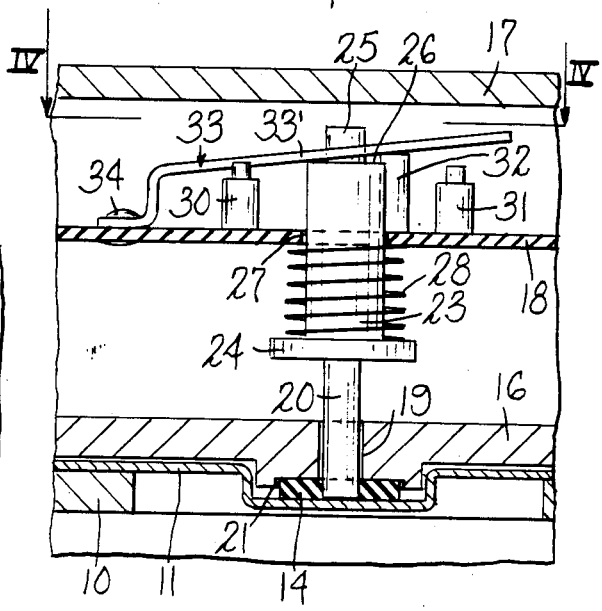
FIG. 3 represents a detail section, as in FIG. 1, showing the tamper indicator in set position, resulting from bolting of the encoder to the meter.

The circuit board is provided with a retaining post 30, a silent contact post 31 and an alarm contact post 32, located relative to each other and to the post 25 on the actuation rod substantially as shown in FIG. 2. A contact spring 33 is fixed to the board at a terminal 34. The spring 33 is angled upwardly and outwardly s shown in FIGS. 3, 5 and 7 so that the straight portion 33' normally extends parallel to the surface of the circuit board. The post 32 is so located relative to post 30 and point 34 that the contact spring, with one side resting against post 30 will be biased into contact with post 32, as shown in FIG. 6.

Terminal 34 and post 32 (as a second terminal) are connected by wires 36, 37 to a remote alarm device, indicated diagrammatically at 38.

FIGS. 1 and 2 illustrate the "as shipped" positions of the respective elements. The contact spring bears against the retaining post 30 with its free end snapped over the end of post 31 and its intermediate bowed portions lying in the path of outward movement of the annular shoulder 26 at the outer end of the actuation rod. The latter is in its inwardly extended position, as shown in FIG. 1, with the stop flange 24 held firmly against the back wall 16 of the encoder, by the action of spring 28. The assembly must be maintained in this condition until it is actually seated on the front wall 10 of the meter casing (FIG. 3) and a check for integrity can be effected by testing a circuit which includes contact post 31.

Figure 4:
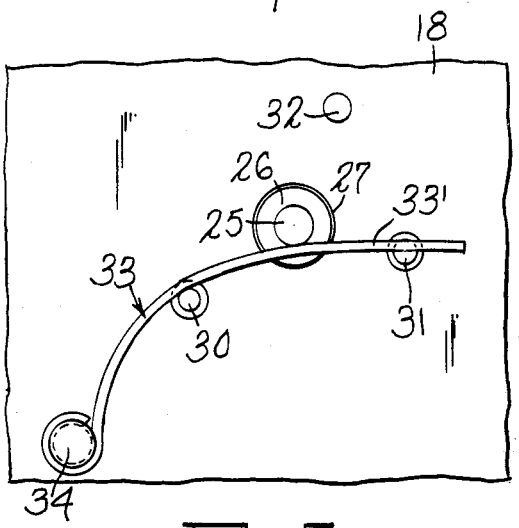
FIG. 4 represents a detail elevation, as in FIG. 2, taken from the line IV—IV of FIG. 3, showing the relative positions of certain parts in the set position.

The act of mounting the encoder on the meter includes the seating of the seat 21 on the annular seal 14 with the end of rod 20 within the seal; the ridge 22 also seats on the gasket 13, and the respective housings are firmly bolted together by bolts 35. The contact of rod 20 with the actuator plate 11 and the relative movement of the latter toward the encoder causes the shoulder 26 to engage the spring 33 and to lift its free end off the post 31, the post 25 at the end of the rod 20 taking over the spring restraining function, with the posts in the position shown in FIGS. 3 and 4. As long as the posts remain in this set position, the alarm circuit is open.

Figure 5:
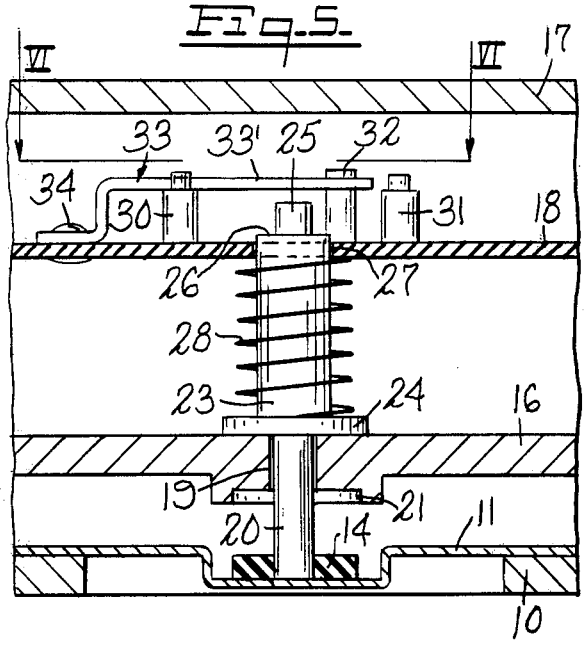
FIG. 5 represents a detail section, like FIG. 3, showing the tamper indicator in alarm position, resulting from separation of the encoder from the meter.
Figure 6:
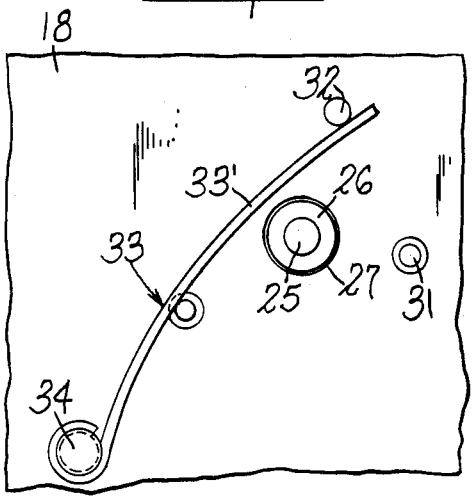
FIG. 6 represents a detail elevation, as in FIG. 4, taken from the line VI—VI of FIG. 5, showing the relative positions of the parts in the alarm position.

However, upon removal of the encoder for any reason, such as an intention to tamper with the meter, even a relatively slight separation of the wall 16 from the plate 11 will permit the rod 20 and its post 25 to move toward the position of FIG. 5, freeing the spring 33 to snap to the more or less straight position of FIG. 6 and into contact with post 32. The end of spring 33 can provide a direct visual indication of tampering by means of a small window which can be located directly above post 32. Tampering is directly indicated if the end of spring 33 is visable in the window. For improved visability a "red flag" could also be attached to the end of spring 33. This also closes the alarm circuit to the device 38, which may be an outside receptacle having means for informing the meter reader that tampering has occurred. Such means may include a signal which is visible through a window in the receptacle or a mechanical or electrical signal adapted to be read by the probe normally used for remote reading of the meter; condition indicators are of many different types and the present invention is capable of actuating any type which may be preferred. An example of a visual signal is the "red flag" which appears on a bottled gas container to show a low level of gas.

Figure 7:
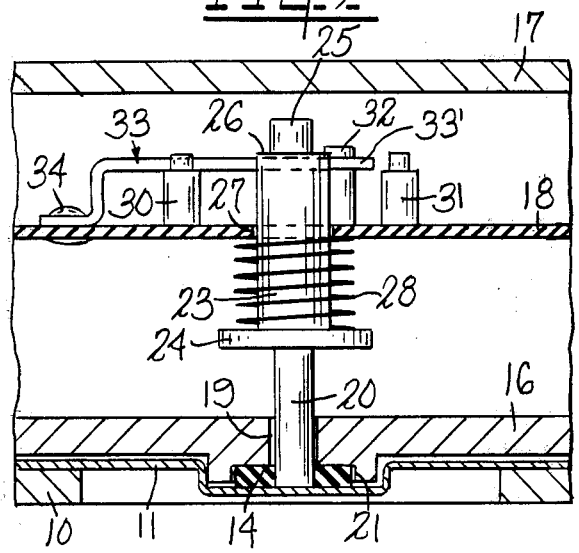
FIG. 7 represents a detail section, like FIGS. 3 and 5, showing the tamper indicator still in alarm position with the encoder remounted on the meter.

An important feature of the present invention is illustrated in FIGS. 6 and 7. When the contact has been closed, as in FIGS. 5 and 6, the spring 33 no longer overlies any part of the rod 20, so that replacing the encoder on the meter, as in FIG. 7, serves to push the actuation rod out to the set position of FIG. 3 but does not disturb the closed circuit position of the contact spring. The tampering indication will thus still be given at the terminal 38 even though the encoder and meter appear to be in their normal attached relationship.

Figure 8:
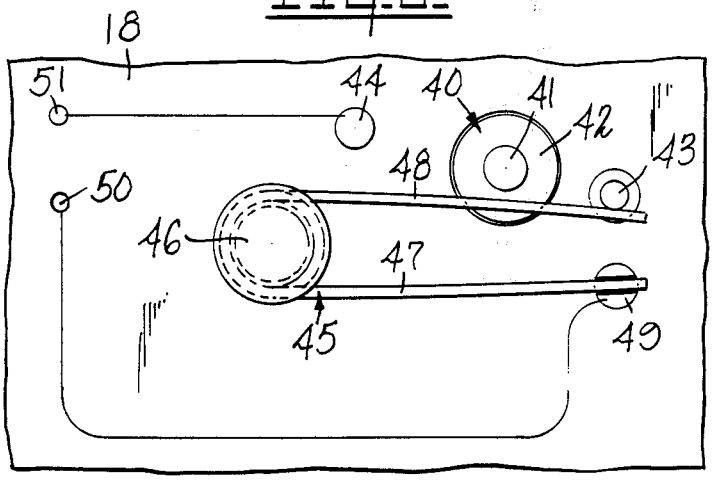
FIG. 8 represents a detail elevation of a modified form of tamper indicator, utilizing a coil spring instead of straight wire spring.

An alternative arrangement is shown in FIG. 8, which corresponds to FIG. 2. The actuating rod 40 is the same as the rod 20, with a post 41 and annular shoulder 42. The post 43 serves the retaining function of post 31, and the alarm contact post 44 serves the function of post 32. The contact spring 33 is replaced by a coil spring 45, wrapped several times around a support 46 and having projecting ends 47, 48. The end 47 is fixed in a terminal post 49 and the end 48 is held, under tension, against the post 43 where it lies in the path of movement of the rod 40. The latter is assumed to be in its "as shipped" position, as shown in FIG. 1. The terminals 50, 51 are connected, respectively, to posts 49 and 44 and represent the remote signaling point corresponding to receptacle 38.

Upon installation of an encoder equipped with this form of the device, the rod 40 is moved by an actuator plate (as in FIG. 3) to a position such that the shoulder 42 lifts the spring arm 48 off the post 43 so that it can rest against the post 41, in the set position. If the encoder is thereafter removed from the meter the rod 40 moves to the FIG. 5 position, permitting the spring end 48 to snap into contact with the post 44, thus closing the alarm circuit. Here, as before, the spring end 48 is not in the path of movement of the actuating rod, so that replacement of the encoder will not interfere with the alarm indication.

Figure 9:
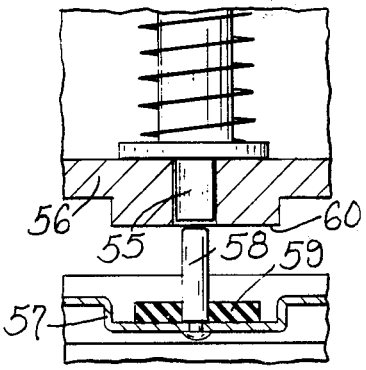
FIG. 9 represents a detail section of another modified form of tamper indicator, arranged to be set by means of a pin on the meter.

According to FIG. 1, the encoder with tamper indicator included is shipped with the actuating element protruding in a position to engage with the actuator plate on the meter. As an alternative, there is shown in FIG. 9 an actuating rod 55 which is shortened so that it will not protrude from the rear wall 56 of the encoder, which therefore need not be handled with special care. In this case, the plate 57 on the meter is provided with a pin 58, in a position to engage the end of rod 55 when the devices are assembled, and to cause the actuating rod to function exactly as previously described. The seal 59 corresponds to the seal 14 and is engaged by the seat 60 on the wall 56.

While the alarm signal is, in every case, initiated electrically, it may be considered expedient to provide mechanical or magnetic means for maintaining the signal in case the electric circuit is interrupted in any manner. Such means are conventional and need not be described.

In many instances, it is sufficient to provide, as a matter of information, a signal which shows that tampering, or an attempt to tamper, has taken place, the signal being observed by the meter reader at some later time. However, tampering with an electric meter can be quite dangerous to the person attempting it and it is therefore contemplated that an indicating system of the type disclosed herein might be connected to a switch for instantly turning off the current to the meter, in addition to giving a signal. A warning of this probable result should constitute an effective deterrent against tampering.

It will thus be seen that the objects set forth above, among those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

What I claim is:

1. An indicator system for signaling the movement of a first device away from a second device comprising, a support fixed in the first device, an elongated contact element associated at one end with a first terminal mounted on the support, a second terminal mounted on the support, said terminals being adapted for connection to an alarm signal circuit, means biasing the contact element toward the second terminal, first restraining means fixed on the support in a position to hold the contact element out of contact with the second terminal, an actuating element movable into and out of the path of movement of the contact element between its restrained position and its contacting position and into engagement with the contact element in its restrained position, means biasing said actuating element out of said path, and means fixed on the second device in a position to move the actuating element against the contact element to dislodge it from the restraining means when the first device is attached to the second device, the actuating element being adapted to act as a second restraining means, whereby separation of the first device from the second device permits the actuating element to move out of the path of movement of the contact element which then contacts the second terminal.

2. An indicator system according to claim 1 wherein the contact element, when contacting the second terminal, is out of the path of movement of the actuating element.

3. An indicator system according to claim 1 wherein the support is flat and the actuating element is a rod movable perpendicularly to the surface of the support.

4. An indicator system according to claim 3 wherein the actuating element is provided with a flat surface adapted to engage the contact element for dislodging it and with a post adapted to act as a second restraining means.

5. An indicator system according to claim 1 wherein the contact element is a spring wire.

6. An indicator system according to claim 1 wherein the contact element includes a coil spring portion and two straight positions.

7. An indicator system according to claim 6 wherein the coil spring portion is coiled around a support, one straight portion projects therefrom a distance sufficient to engage the first restraining means and the second terminal, and the other straight portion is connected to the first terminal.

8. An indicator system according to claim 1 wherein the means fixed on the second device is a plate adapted to engage an end of the actuating element.

9. An indicator system according to claim 1 wherein the means fixed on the second device is a pin adapted to engage an end of the actuating element.

10. An indicator system according to claim 1 wherein the first device is an encoder adapted for attachment to a meter and the second device is an energy monitoring meter.

* * * * *